United States Patent [19]

Mulder

[11] 4,188,791

[45] Feb. 19, 1980

[54] PISTON-CENTERING SYSTEM FOR A HOT GAS MACHINE

[75] Inventor: Jan Mulder, Eindhoven, Netherlands

[73] Assignee: U.S. Philips Corporation, New York, N.Y.

[21] Appl. No.: 881,576

[22] Filed: Feb. 27, 1978

[30] Foreign Application Priority Data

Mar. 2, 1977 [NL] Netherlands ..... 7702207

[51] Int. Cl.[2] ..... F02G 1/04

[52] U.S. Cl. ..... 60/520

[58] Field of Search ..... 62/6; 60/517, 518, 519, 60/520, 522

[56] References Cited

U.S. PATENT DOCUMENTS 3,937,018 2/1976 Beale ..... 60/520

FOREIGN PATENT DOCUMENTS 1478209 6/1977 United Kingdom ..... 60/525

*Primary Examiner*—Allen M. Ostrager

*Attorney, Agent, or Firm*—David R. Treacy

[57] ABSTRACT

A free piston hot gas reciprocating machine having, one piston surface which varies the volume of a working space, while its other surface bounds a buffer space of constant pressure, and a control mechanism formed by an auxiliary cylinder and an auxiliary piston which is movable therein. The control mechanism maintains a given central position of the free piston by instantaneously opening a connection between the buffer space and the auxiliary cylinder space.

4 Claims, 8 Drawing Figures

PISTON-CENTERING SYSTEM FOR A HOT GAS MACHINE

BACKGROUND OF THE INVENTION

The invention relates to a hot gas reciprocating machine, comprising at least one working space in which a working medium performs a thermodynamic cycle, said working space comprising a compression space and an expansion space of mutually different mean temperatures during operation which are connected to each other via head exchangers, including a regenerator; and more particularly, to such a machine having at least one free piston which is reciprocatable in a cylinder, one piston surface varying the volume of the working space, and the other surface forming a part of the boundary of a buffer space which also contains working medium during operation at an at least substantially constant pressure which corresponds to the mean working medium pressure in the working space. Such a machine also has a control mechanism for maintaining a given central position of the free piston by the instantaneous opening of a connection between the buffer space and a space in which a variable pressure prevails, said control mechanism comprising two elements which are constructed as an auxiliary cylinder and an auxiliary piston which is movable therein so as to vary the volume of the auxiliary cylinder space, one of these elements being connected to the free piston and the other element being rigidly arranged, the auxiliary piston having at least one first duct whose end opens through the auxiliary piston wall opposite with the auxiliary cylinder wall, where it corresponds, in a given position of the auxiliary piston, to at least one second duct in the auxiliary cylinder wall which communicates with the buffer space.

Within the scope of the present invention, hot gas reciprocating machines are to be understood to mean cold gas regrigerators, hot gas engines and heat pumps.

A hot gas reciprocating machine of the described kind has been proposed in the non-prepublished Netherlands Patent Application No. 7,514,812 to which U.S. Pat. No. 4,058,382 corresponds (FIGS. 4 and 5).

In the proposed hot gas reciprocating machine, the end of the duct in the auxiliary piston which is remote from the buffer space opens into the working space of the machine, so that a given central position of the free piston is maintained in that an open connection exists instantaneously between the buffer space and the working space. Depending on the situation, working medium then flows from the buffer space to the working space or in the reverse direction.

This construction has a drawback in that the thermodynamic cycle taking place in the working space is adversely affected. The maximum/minimum pressure ratio of the working medium participating in the cycle. is affected while at the same time a phase shift occurs, i.e. the phase difference between the pressure variation and the volume variation of the working medium in the working space changes. This leads to a reduction of the efficiency of the machine.

SUMMARY OF THE INVENTION

The object of the invention is to provide an improved hot gas machine in which the control of the central position of the free piston has no adverse effects on the thermodynamic cycle.

In accordance with the invention in a free-piston hot gas machine other end of the first duct in the auxiliary piston opens into the auxiliary cylinder space.

In a preferred embodiment of the invention the rigidly arranged element (auxiliary piston or cylinder) is adjustable with respect to the cylinder in the direction of the cylinder axis. The central position of the free piston is thus adjustable.

In a different preferred embodiment of the invention the element which is connected to the free piston is adjustable in the axial direction with respect to the free piston. The central position of the piston is thus also adjustable.

Preferably, both elements are accommodated in the buffer space for size considerations.

The invention will be described in detail hereinafter with reference to the drawing which diagrammatically shows, besides two graphs which illustrate the principle, some embodiments of the hot gas reciprocating machine (not to scale).

DESCRIPTION OF THE PREFERRED EMBODIMENTS

Figure 1:
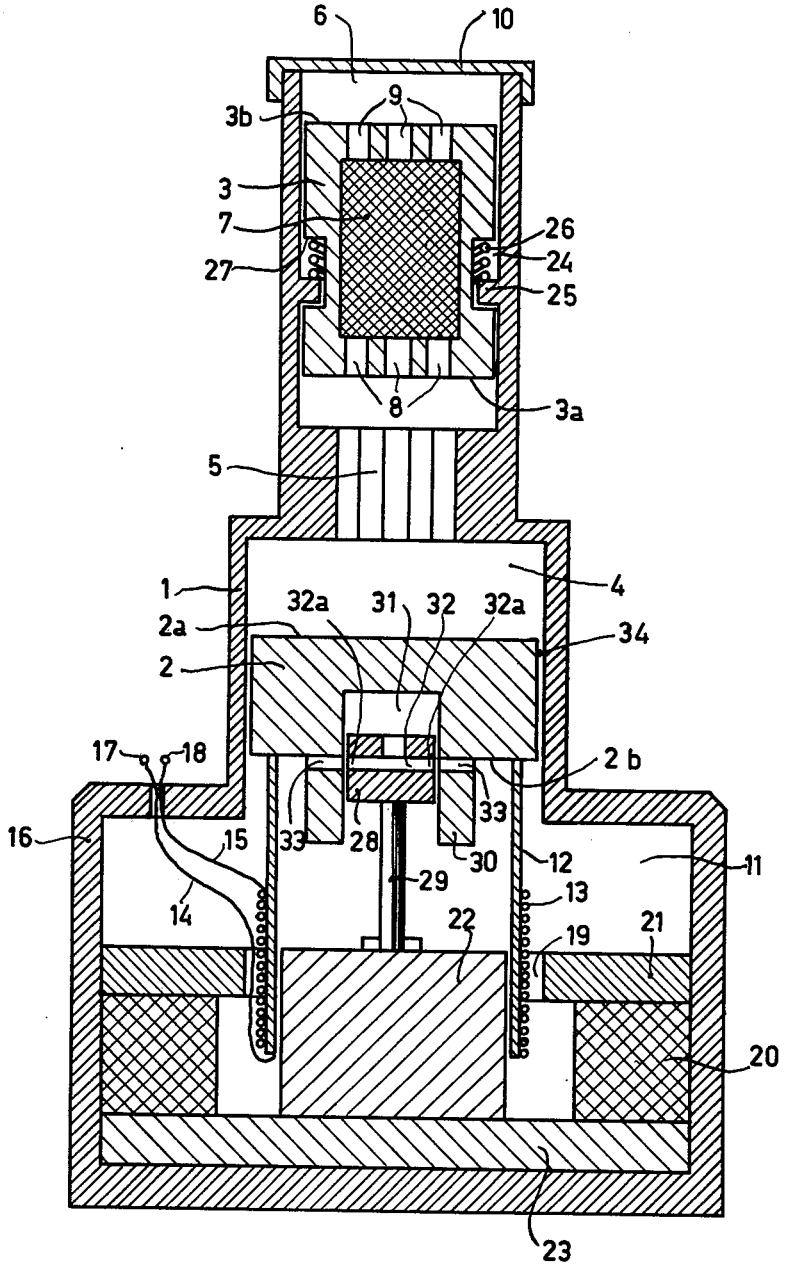
FIG. 1 is a longitudinal sectional view of a cold gas refrigerator in which the control mechanism for maintaining a given central position of the free piston comprises an auxiliary piston which is rigidly arranged in the buffer space and which is reciprocatable in an auxiliary cylinder which is connected to the free piston.

The reference numeral 1 in FIG. 1 denotes a cylinder in which a free piston 2 and a free displacer 3 are reciprocatable at a mutual phase difference. Between the working surface 2*a* of the piston 2 and the working surface 3*a* of displacer 3 a compression space 4 is present which accommodates a cooler 5. The upper working surface 3*b* of the displacer 3 bounds an expansion space 6 which constitutes the working space in conjunction with the compression space 4. The displacer 3 accommodates a regenerator 7 which is in thermal contact with working medium flowing on its lower side through bores 8 and on its upper side through bores 9. The cold gas refrigerator includes a freezer or cold surface 10 as a heat exchanger for the exchange of heat between expanded, cold working medium and an object to be cooled.

When the piston 2 and the displacer 3 move at a mutual phase difference during operation, a working medium (for example, helium or hydrogen) in the working space of the machine is alternately compressed and expanded, cold being produced due to the expansion. The compression of the working medium takes place when substantially all of it is present in the compression space 4. The working medium successively flows through the cooler 5, while giving off compression heat, the bores 8, the regenerator 7 while giving off heat, and the bores 9 to the expansion space 6. Expansion of the working medium takes place when substantially all the working medium is present in the expansion space 6. The working medium then flows back again along the described path in the reverse order, after having taken up heat in the freezer 10 from the object to be cooled (not shown), the heat previously stored in the regenerator 7 also being taken up again.

The lower side 2*b* of the free piston 2 bounds a buffer space 11 which also contains working medium during operation at a substantially constant pressure which corresponds to the mean working medium pressure in the working space. The lower side 2*b* of the piston supports a light-weight sleeve 12 of a non-magnetic and non-magnetisable material such as hard paper or aluminum. Around the sleeve 12 an electrical current conductor is wound to form an armature coil 13 to where current supply wires 13 and 15 are connected. These wires are brought out through the wall of the housing 16 which is connected to the cylinder 1 in a gastight manner, and are provided with electrical contacts 17 and 18, respectively, on the outside. The armature coil 13 is reciprocatable in the axial direction of the piston 2 in an annular gap 19 in which a permanent magnetic field prevails, the lines of force of which extend in radial directions, tranversely of the movement direction of the armature coil.

In this embodiment the permanent magnetic field is provided by an annular permanent magnet 20 having poles on its upper and lower side, a soft-iron ring 21, a solid soft-iron cylinder 22, and a soft-iron circular disk 23.

The permanent magnet and the soft-iron components together constitute a closed magnetic circuit, that is, a circuit of closed magnetic lines of force. During operation, the contacts 17 and 18 are connected to an electrical alternating current source (for example, the mains) having a frequency $f_o$ (for example, 50 Hertz). Under the influence of the permanent magnetic field in the gap 19, Lorentz forces which are alternately directed upwards and downwards are exerted on the armature coil 13 carrying alternating current, with the result that the assembly formed by the piston 2, the sleeve 12 and the armature coil 13 starts to resonate. This is effected so that the resonant frequency of the system formed by the moving assembly and the working medium in the working space is at least substantially equal to the alternating current frequency $f_o$ (a deviation of 10% is still acceptable). The working medium in the working space then acts as a spring system. The alternating current need deliver only so much energy to the resonant system of piston/armature coil assembly and working medium, through the armature coil 13, as is required to compensate for the work performed by the working medium and the friction losses.

The displacer 3 also has a circumferential groove, so that an annular intermediate space 24 is formed between the cylinder 1 and the displacer 3. The wall of the cylinder 1 is provided with a projection 25. A resilient element 26 is connected on the one side to the projection 25 and on the other side to an annular face 27 of the groove in the displacer 3.

The resilient element 26 limits the stroke of the displacer 3 and constitutes a mass/spring system in conjunction therewith, so that the displacer, like the piston, performs a purely harmonic movement of the same frequency as the piston, but at a phase difference with respect thereto. The spring constant of the resilient element 26 and the mass of the displacer 3 are chosen so that the frequency $f_1$ at which this system is able to resonate is higher than the resonant frequency f of the system formed by the piston/armature coil assembly and the working medium. During operation, at equal vibration frequencies of the piston 2 and displacer 3, the volume variation of the expansion space then leads the pressure variation occurring in this space, with the result that cold is produced in the expansion space 6.

An auxiliary piston 28, connected to the soft-iron cylinder 22 by a rod 29, is rigidly arranged in the buffer space 11. The auxiliary piston 28 is movable in an auxiliary cylinder 30 which is connected to the free piston 2 and can thus vary the volume of a space 31.

In the auxiliary piston 28 there is provided a first duct system 32 which communicates at one end with the space 31 and which at the other end opens at different locations 32*a* through the auxiliary piston wall which cooperates with the auxiliary cylinder wall, where it cooperates with ports or ends of second ducts in the wall of the auxiliary cylinder 30. The ducts 33 are in open communication with the buffer space 11. As appears from FIG. 2, the cycle pressure $P_1$ in the working space 4,6 of FIG. 1 is higher than the pressure $P_2$ in the buffer space 11 during the time interval A. Due to leakage through the gap 34 between the wall of the piston 2 and the cylinder 1, working medium then flows from the working space 4,6 to the buffer space 11. During the time interval B (FIG. 2), however, the pressure in the buffer space 11 is higher than that in the working space 4, 6, so that medium then flows from the buffer space 11, through the gap 34, to the working space 4, 6. However, the pressure of the medium flowing from the working space during the inteval A is higher than the pressure of the medium flowing from the buffer space during the interval B. This means that the medium volume flows to and from the working space are equal, but not the mass flows. The medium mass flow to the buffer space 11 is larger than that to the working space 4, 6. As a result, the piston 2 would gradually assume a higher central position, which means that the central position of the piston would be displaced in the direction towards the compression space 4.

This is prevented by the operation of the control mechanism formed by the auxiliary piston 28 and the auxiliary cylinder 30.

When the piston reciprocates at the desired nominal central position, the ends of the ducts 33 pass the duct locations 32*a* at the instants $t_1$, $t_2$ and $t_3$ (FIG. 2) at which the pressures in the working space, the buffer space and the auxiliary cylinder space are equal. No working medium then flows through the ducts 33 and the duct system 32.

If the mean position of the piston 2 is shifted upwards due to a medium mass flow from the compression space 4, through the gap 34 to the buffer space 11, which is larger than the medium mass flow in the reverse direction, the ends of the ducts 33 pass the duct end locations 32*a* during the downward movement of the piston 2 at an instant, for example $t_4$, which is later than $t_2$; while during the upward movement of the piston 2 the ducts 33 pass the end locations 32*a* at an instant $t_5$ which is earlier than the instant $t_3$. As a result, at the instants $t_4$ and $t_5$, at which the pressure $P_3$ in the auxiliary cylinder space 31 is higher than the pressure $P_2$ in the buffer space 11, working medium flows from the auxiliary cylinder space 31, through the duct system 32 and the ducts 33, to the buffer space 11. The pressure level in the auxiliary cylinder space 31 thus decreases, which causes an additional reversing,, downwards directed force on the piston 2, so that the original central position is restored.

Should the mean position of the piston 2 be displaced downwards, for example, under the influence of its own weight, in the direction of the soft-iron cylinder 22, the duct 33 pass the duct end locations 32*a* during the upwards movement of the piston 2 at an instant, for example $t_6$, which is later than $t_1$ (FIG. 2); during the downward movement of the piston 2, they pass at an instant $t_7$ which is earlier than $t_2$. At the instants $t_6$ and $t_7$, at which the pressure $P_2$ in the buffer space 11 exceeds the pressure $P_3$ in the auxiliary cylinder space 31, working medium then flows from the buffer space 11, through the ducts 33 and the duct system 32, to the auxiliary cylinder space 31. The mean pressure in the auxiliary cylinder space 31 then increases, with the result that the mean piston position is moved upwards to the original central position.

Figure 3:
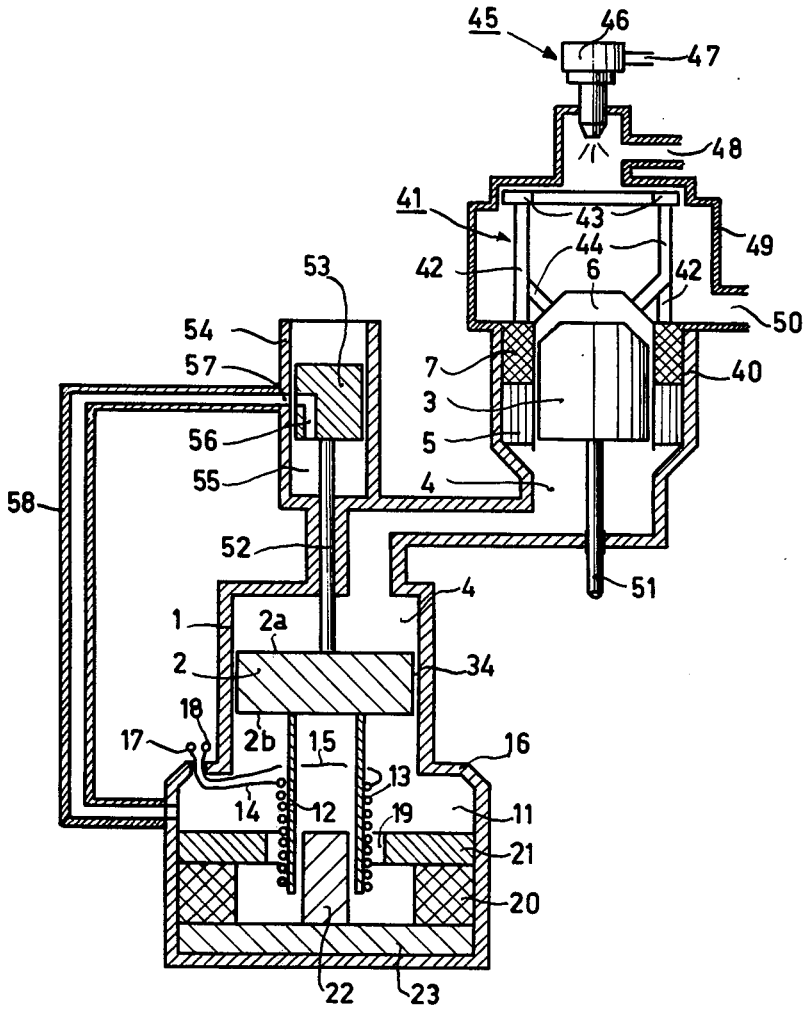
FIG. 3 is a longitudinal sectional view of a hot gas engine for generating electrical energy (generator) in which the auxiliary piston is connected to the free piston and is movable in an auxiliary cylinder connected to the buffer space.

Parts of the hot gas engine shown in FIG. 3 which correspond to the parts of the cold gas refrigerator shown in FIG. 1 are denoted by the same reference numerals.

In the hot gas engine of FIG. 3 the compression space 4 communicates, through the cooler 5, the regenerator 7 which is rigidly arranged in a cylinder 40, and a heater 41, with the expansion space 6. The heater 40 comprises a number of pipes 42 which are connected at one end to the regenerator 7 and at the other end to an annular duct 43, and also comprises a number of pipes 44 which are connected at one end to the annular duct 43 and at the other end to the expansion space 6.

Heat originating from a burner device 45 is given off to the working medium flowing through the heater pipes 42, 44 during operation. The burner device 45 comprises a burner 46 with a fuel inlet 47 and an air inlet 48. After having given off heat to the heater 41, arranged inside a housing 49, the combustion gases leave the housing 49 through the outlet 50.

The displacer 3 is coupled, by a displacer rod 51, to a drive system not shown. During operation of the hot gas engine, during which the displacer 3 and the piston 2 move at a mutual phase difference, the thermal energy applied to the heater 41 is utilised to drive the piston 2, so that electrical energy is generated in the armature coil 13. When the displacer 3 is provided with an electrodynamic drive, part of the electrical energy generated in the armature coil 13 and be used, after the starting of the hot gas engine, for powering the armature coil coupled to the displacer rod 3.

An auxiliary piston 53, being reciprocatable in an auxiliary cylinder 54, is connected to the free piston 2 by a rod 52. The auxiliary piston 53 varies the volume of an auxiliary cylinder space 55. In the auxiliary piston 53 there is provided a first duct 56, one end of which opens into the auxiliary cylinder space 55, while its other end cooperates with a second duct or port 57 in the wall of the auxiliary cylinder 54, the port 57 being in open communication with the buffer space 11 through a duct 58.

Figure 2:
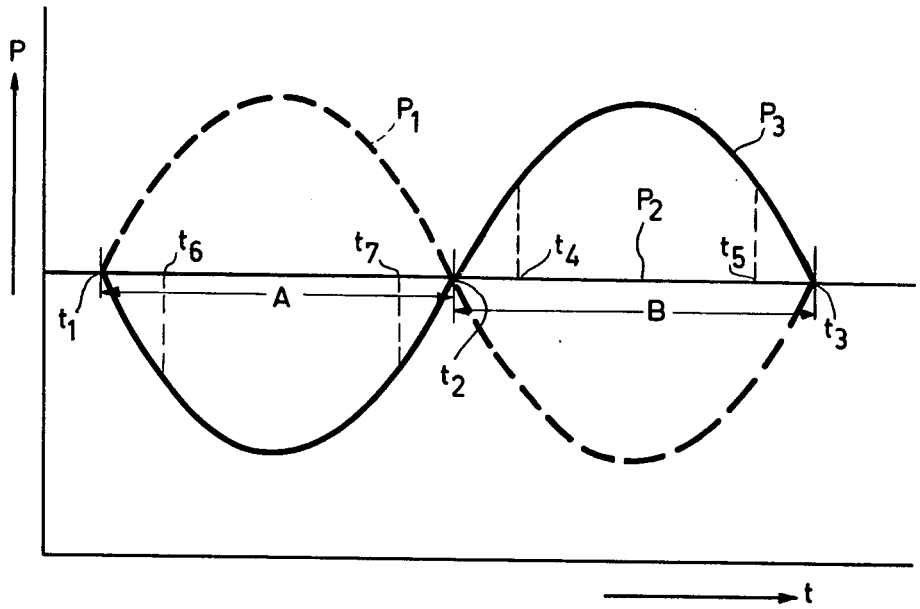
FIG. 2 graphically illustrates the pressure (P) as a function of the time (t) for the working medium ($P_1$) participating in the cycle in the working space of the hot gas reciprocating machine shown in FIG. 1, for the working medium ($P_2$) in the buffer space, and for the working medium ($P_3$) in the auxiliary cylinder space of said machine.

The control of the central position of the piston 2 is identical to that shown in FIG. 2, so that no further description is required.

Figure 4:
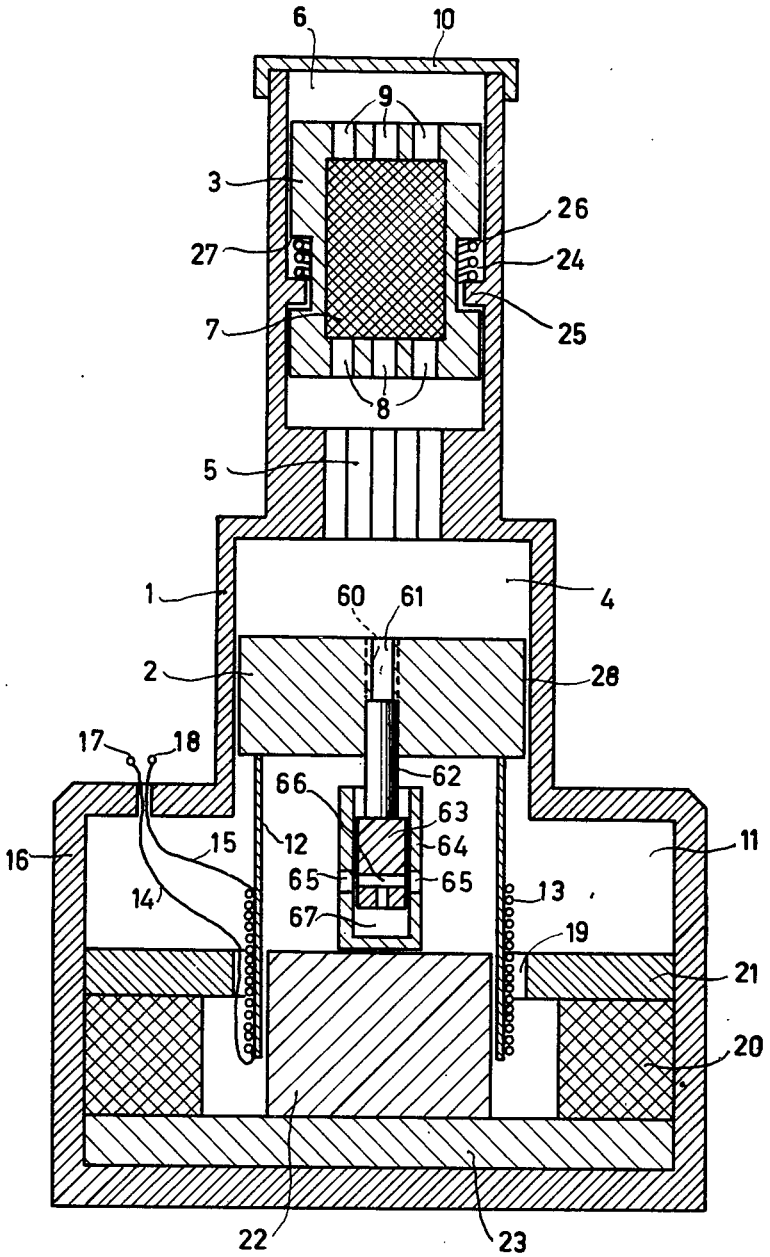
FIG. 4 is a longitudinal sectional view of a cold gas refrigerator, comprising an auxiliary cylinder which is rigidly arranged in the buffer space and an auxiliary piston which is coupled to the free piston to be axially adjustable.

Parts of the cold gas refrigerator shown in FIG. 4 which correspond to parts of the machine shown in FIG. 1, are denoted by the same reference numerals.

In the embodiment of FIG. 4, a bore 61 with a thread 60 is provided in the piston 2. A rod 62 is screwed into the bore 61 in a gastight manner, to connect an auxiliary piston 63, in an auxiliary cylinder 64 having ducts or ports 65, for reciprocation synchronously with the piston 2. In the piston position shown, the buffer space 11 communicates through the ports 65, and a duct system 66 in the auxiliary piston 63, with an auxiliary cylinder space 67. The operation of the control mechanism for the central position is identical to that described with reference to FIG. 1.

The desired central position of the piston 2 can be adjusted by screwing the rod 62 further into or out of the bore 61.

Figure 5:
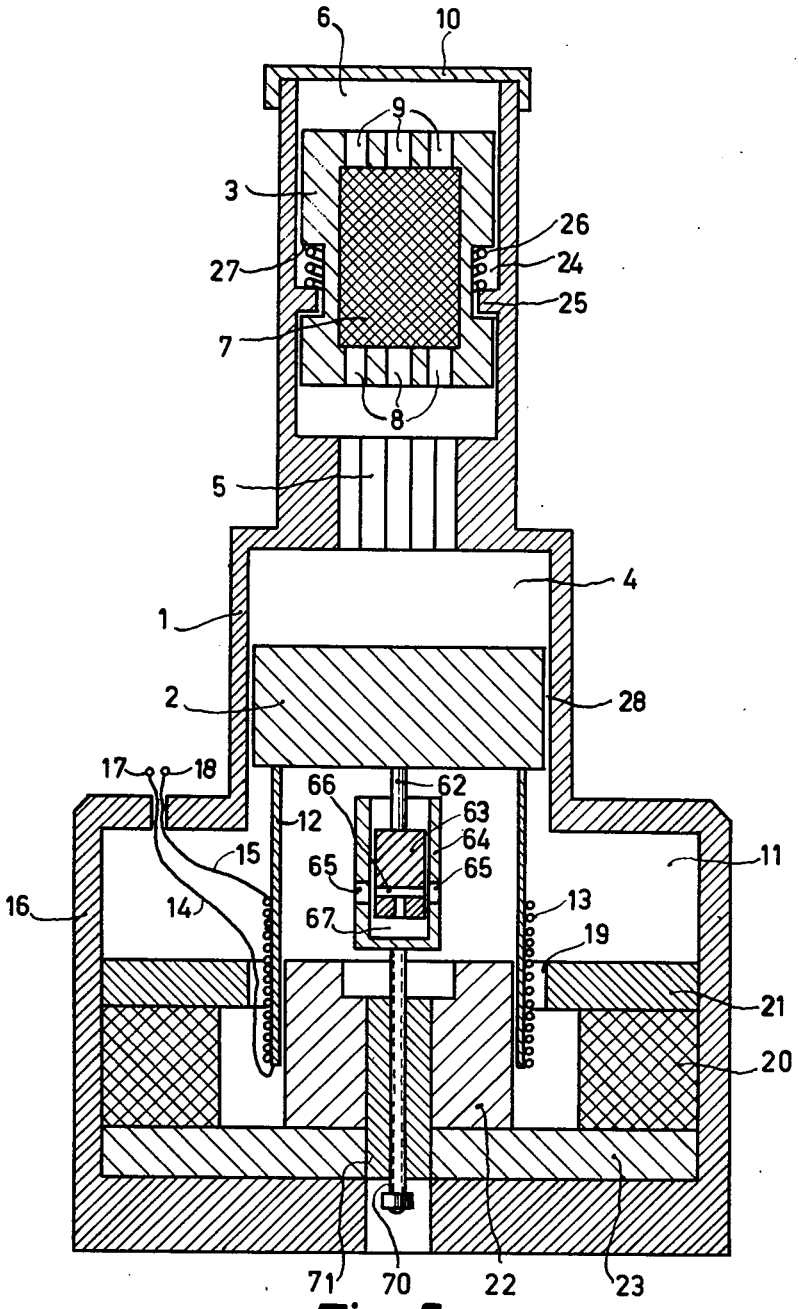
FIG. 5 is a longitudinal sectional view of a cold gas refrigerator, comprising an auxiliary piston which is connected to the free piston and an auxiliary cylinder which is arranged in the buffer space to be axially adjustable.

Parts of the cold gas refrigerator shown in FIG. 5 which correspond to those of FIG. 4 are denoted by the same reference numerals.

The rod 62 is now rigidly connected to the piston 2, the auxiliary cylinder 64 being adjustable in the axial direction by means of an adjusting screw 70 in a bushing 71. Thus, the central position of the piston 2 is again adjustable, an advantage being obtained in that the adjustment can be externally performed during operation.

Figure 6:
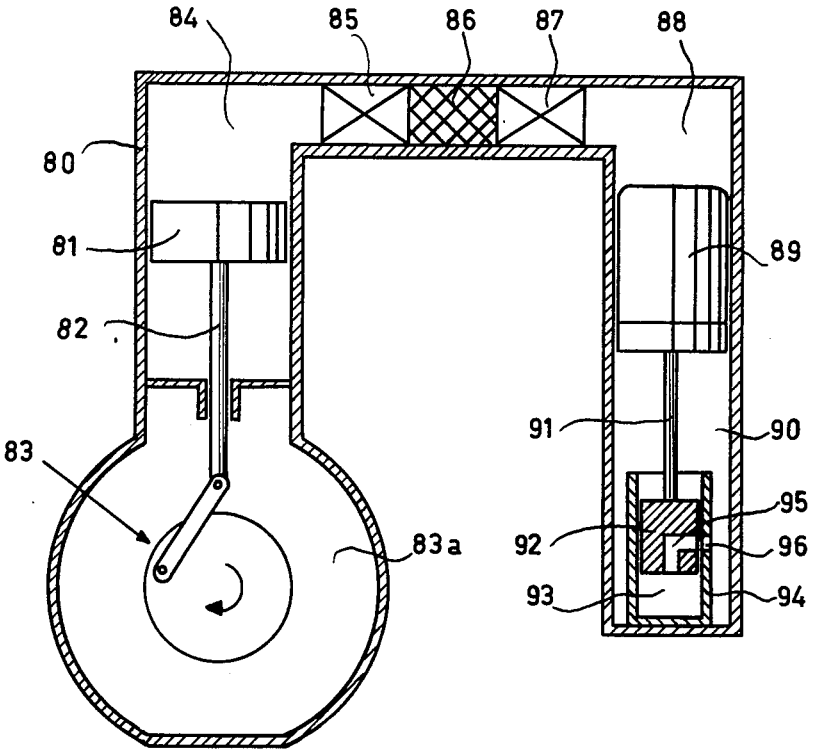
FIG. 6 is a longitudinal sectional view of a cold gas refrigerator in which the expansion piston forms a free piston which is provided with an auxiliary piston which is reciprocatable in an auxiliary cylinder.

FIG. 6 shows a cold gas refrigerator, comprising a cylinder 80 which accommodates a compression piston 81 which is connected by a piston rod 82 to a drive system 83 in a crank case space 83*a*. The compression piston 81 varies the volume of a compression space 84 when it moves. The compression space 84 communicates through a cooler 5, regenerator 86 and freezer 87 with an expansion space 88. The expansion space 88 is bounded by an expansion piston 89, the other end of which bounds a buffer space 90 which contains working medium at a pressure which is equal to the mean working medium pressure in the expansion space 88. The expansion piston 89 is connected to a piston rod 91 which supports an auxiliary piston 92 which varies the volume of the space 93 inside an auxiliary cylinder 94 when it moves.

A first duct 95 is provided in the auxiliary piston 92 and a second duct or port 96 is provided in the auxiliary cylinder 94.

In the situation shown, the buffer space 90 is in open communication, through the port 96 and the duct 95 with the auxiliary cylinder space 93. The operation of the central position control mechanism for the piston 89, formed by the auxiliary piston 92 and the auxiliary cylinder 94, is identical to that described with reference to FIG. 1.

Obviously, the compression piston 81 may also be constructed as a free piston provided with a central position control system, for example, as shown in FIG. 1. The crank case space 83*a* may form one integral unit with the buffer space 90, if desired.

Figure 8:
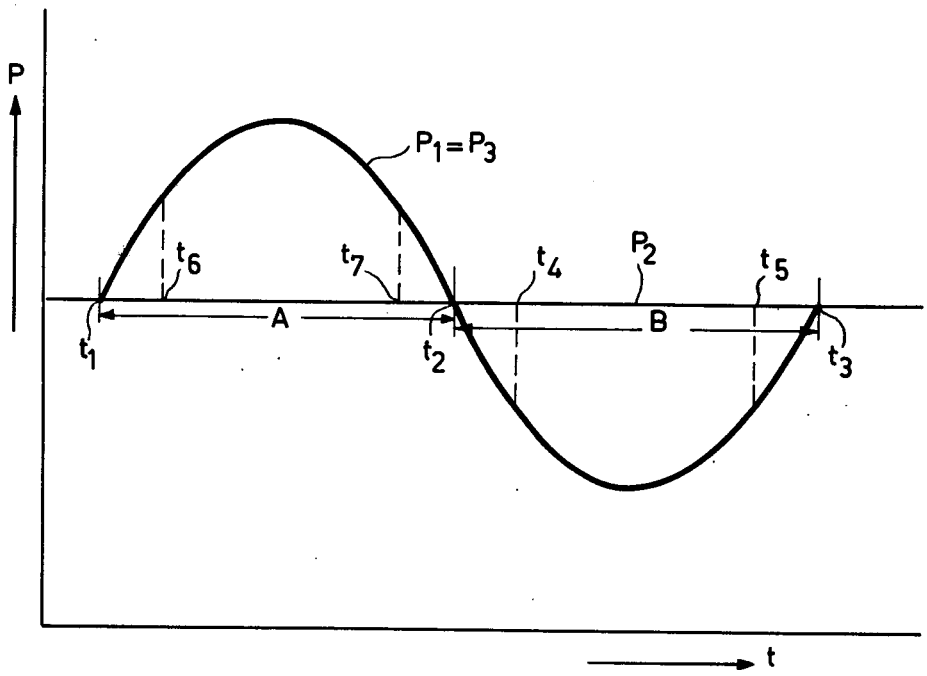
FIG. 8 graphically shows the pressure (P) as a function of the time (t) for the working medium ($P_1$) participating in the cycle of the working space of the hot gas engine of FIG. 7, for the working medium ($P_2$) in the buffer space, and for the working medium ($P_3$) in the auxiliary cylinder space, $P_3$ being in phase with $P_1$.
Figure 7:
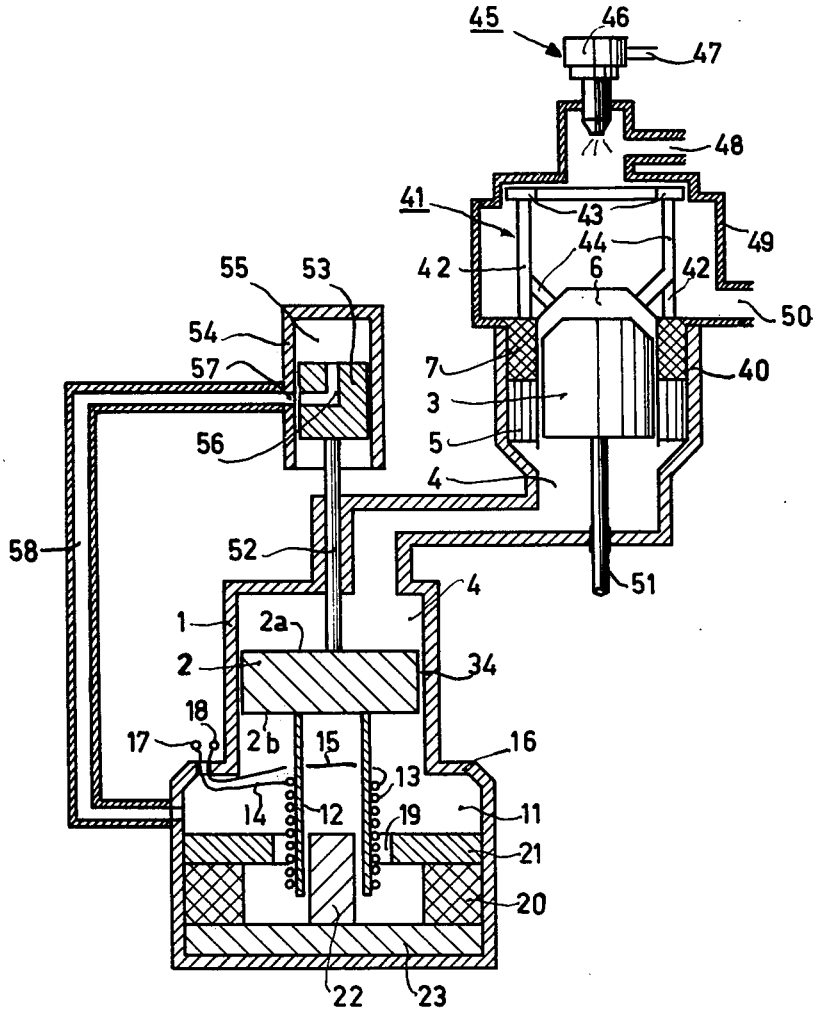
FIG. 7 shows a slightly modified version of the hot gas engine shown in FIG. 3.

The reference numerals of FIG. 3 are used for all parts of the hot gas engine shown in FIG. 7, which differs from that shown in FIG. 3 only in that now the upper side of the auxiliary piston 53 varies the volume of the auxiliary cylinder space 55. This means that the pressure variation $P_3$ in the auxiliary cylinder space 55 is now in phase with the pressure variation $P_1$ in the compression space 4, which is shown in FIG. 8.

When the mean position of the piston 2 moves upward again, the duct 56 passes the port 57, during the downward movement of the piston 2, at the instant $t_4$ which is later than $t_2$, while during the upward movement of the piston 2 the duct 56 passes the port 57 at the instant $t_5$ which is earlier than the instant $T_5$. As a result, at the instants $t_4$ and $t_5$, at which the pressure $P_2$ in the buffer space 11 is higher than the pressure $P_3$ in the auxiliary cylinder space 55, working medium flows from the buffer space 11, through the duct 58, the port 57 and the duct 56, to the auxiliary cylinder space 55, so that the pressure level in the latter space increases. Thus, the piston 2 is driven back to its original central position again.

When the mean position of the piston 2 moves downwards, the duct 56 passes the port 57, during the upward movement of the piston 2, at an instant $t_6$which is later than $t_1$ (FIG. 8), and passes this port during the downward movement of the piston 2 at an instant $t_7$ which is earlier than $t_2$. At the instants $t_6$ and $t_7$, the pressure $P_3$ in the auxiliary cylinder space 55 is higher than the pressure $P_2$ in the buffer space 11. Working medium then flows the auxiliary cylinder space 55 to the buffer space 11. The pressure level in the auxiliary cylinder space 55 decreases, with the result that the piston 2 assumes the higher, original central position again.

It will be obvious that a central position control system thus can function when the variable pressures in the working space and the auxiliary cylinder space are in phase (FIG. 8) as well as when these pressures are of opposite phase (180° phase difference) (FIG. 2).

What is claimed is:

1. A free piston hot gas machine comprising at least one working space in which a working medium performs a thermodynamic cycle, the working space including a compression space and an expansion space of mutually different mean temperatures during operation, a buffer space which contains working medium during operation at an at least substantially constant pressure which corresponds to the mean working medium pressure in the working space, at least one heat exchanger including a regenerator, connecting said compression and expansion spaces, a cylinder containing at least one free piston reciprocatable therein, one surface of the piston varying the volume of the working space, and the other surface forming a part of the boundary of the buffer space, and a control mechanism for maintaining a given central position of the free piston by instantaneous opening of a connection between the buffer space and a space in which a variable pressure prevails, said control mechanism comprising an auxiliary cylinder element and an auxiliary piston element movable within the auxiliary cylinder element, one of said elements being connected to the free piston and the other element being rigidly arranged, said auxiliary piston having at least a first duct therein having an end which opens through the auxiliary piston wall, said auxiliary cylinder having at least a second duct which communicates with said buffer space and has an end opening through the auxiliary cylinder wall, in a given position of the auxiliary piston said ends of said ducts communicating with each other, wherein said auxiliary piston element is arranged so as to vary the volume of an auxiliary cylinder space, and said first duct is arranged to communicate between said piston wall and the auxiliary cylinder space.

2. A hot gas reciprocating machine as claimed in Claim 1, wherein the rigidly arranged element is adjustable in position with respect to the cylinder in the direction of the cylinder axis.

3. A hot gas reciprocating machine as claimed in claim 1, wherein the element which is connected to the free piston is adjustable in the axial direction with respect to the free piston.

4. A hot gas reciprocating machine as claimed in Claim 1, 2 or 3, wherein both elements are accommodated in the buffer space.

* * * * *